US008082839B2

(12) United States Patent
Huang

(10) Patent No.: US 8,082,839 B2
(45) Date of Patent: Dec. 27, 2011

(54) ONE-PIECE STEEL PISTON

(75) Inventor: Yuejun Huang, Fort Wayne, IN (US)

(73) Assignee: Karl Schmidt Unisia, Inc., Marinette, WI (US)

( * ) Notice: Subject to any disclaimer, the term of this patent is extended or adjusted under 35 U.S.C. 154(b) by 406 days.

(21) Appl. No.: 11/174,699

(22) Filed: Jul. 5, 2005

(65) Prior Publication Data

US 2006/0005701 A1 Jan. 12, 2006

Related U.S. Application Data

(63) Continuation-in-part of application No. 10/885,810, filed on Jul. 7, 2004, now Pat. No. 7,104,183.

(51) Int. Cl.
*F01B 31/08* (2006.01)

(52) U.S. Cl. ..... 92/186; 29/888.04

(58) Field of Classification Search ..... 92/186; 29/888.04

See application file for complete search history.

(56) References Cited

U.S. PATENT DOCUMENTS

| | | | | |
|---|---|---|---|---|
| 3,341,924 | A * | 9/1967 | Clary et al. | 92/186 |
| 4,662,047 | A | 5/1987 | Berchem | |
| 4,683,809 | A | 8/1987 | Taylor | |
| 4,843,698 | A | 7/1989 | Ripberger et al. | |
| 4,867,119 | A | 9/1989 | Cooper et al. | |
| 4,909,133 | A | 3/1990 | Taylor et al. | |
| 5,070,768 | A | 12/1991 | Goncalves et al. | |
| 5,285,840 | A | 2/1994 | Hayashi et al. | |
| 5,487,364 | A | 1/1996 | Takeda et al. | |
| 5,809,962 | A | 9/1998 | Abbott et al. | |
| 5,839,352 | A | 11/1998 | Ribeiro et al. | |
| 5,924,472 | A | 7/1999 | Suzuki et al. | |
| 6,026,777 | A | 2/2000 | Kemnitz et al. | |
| 6,112,715 | A | 9/2000 | Nigro et al. | |
| 6,116,202 | A | 9/2000 | Rivers et al. | |
| 6,202,619 | B1 | 3/2001 | Keller et al. | |
| 6,223,701 | B1 | 5/2001 | Kruse | |
| 6,546,993 | B1 | 4/2003 | Tilach | |
| 6,698,392 | B1 | 3/2004 | Kohnert et al. | |
| 7,104,183 | B2 * | 9/2006 | Huang | 92/186 |
| 2003/0075042 | A1 * | 4/2003 | Gaiser et al. | 92/231 |
| 2004/0168319 | A1 * | 9/2004 | Mielke | 29/888.04 |
| 2005/0283976 | A1 * | 12/2005 | Otaka | 29/888.04 |

FOREIGN PATENT DOCUMENTS

| | | | |
|---|---|---|---|
| CH | 230566 | | 1/1944 |
| CN | 1019892 | | 2/1993 |
| DE | 926169 | | 4/1955 |
| DE | 1103698 | | 3/1961 |
| DE | 1210302 | * | 2/1966 |
| DE | 44 46 726 | A1 | 12/1994 |
| EP | 0 992 670 | A2 | 10/1999 |
| GB | 1092720 | | 11/1967 |
| WO | WO 01/50042 | A1 | 7/2001 |

* cited by examiner

*Primary Examiner* — Daniel Lopez
(74) *Attorney, Agent, or Firm* — Butzel Long

(57) ABSTRACT

A one-piece steel piston that is made from a piston blank that includes a portion that is configured and designed to be displaced to form a cooling gallery and ring belt. The piston blank can be formed by a casting or forging process. The portion that is designed and configured to be displaced is a flange that extends radially outward. The flange is bent downward or upward so that a peripheral edge of the flange contacts another portion of the piston. The peripheral edge of the flange and the other portion of the piston can be welded together or mechanically engaged.

17 Claims, 6 Drawing Sheets

ONE-PIECE STEEL PISTON

RELATED APPLICATION

The present application is a Continuation-In-Part of U.S. patent application Ser. No. 10/885,810, filed Jul. 7, 2004 now U.S. Pat. No. 7,104,183, the complete disclosure of which is hereby expressly incorporated by reference.

TECHNICAL FIELD

The present invention relates to piston designs for internal combustion engines. More specifically, the present invention is directed to one-piece steel piston designs and methods of making the same.

BACKGROUND ART

Internal combustion engine pistons are exposed to extremely tough working environments. They are subjected to high temperatures, explosive firing pressures, side forces and inertial forces. As an engine's output is increased more and more, temperatures, cylinder pressures and engine speed can become so high that traditional materials from which pistons are made, including aluminum alloys, reach their fatigue strengths.

Articulated pistons are two-piece pistons that have a crown made of steel and a skirt made from aluminum. The crown and skirt are joined together by means of a piston pin. In articulated pistons, the crown and skirt are able to articulate so as to move independently of each other.

Articulated pistons provide several advantages over one-piece cast aluminum pistons. For example, the steel crown in articulated pistons has a thermal expansion rate that is more similar to the thermal expansion rate of iron piston liners than aluminum. In addition, heat from the steel crowns of articulated pistons is not as easily transferred to the aluminum skirt so the skirt retains its shape better. Further, piston secondary motion in articulated pistons can be better than in one-piece pistons.

Although articulated pistons can withstand relatively higher pressures and temperatures, there are some practical design limitations associated with articulated pistons. For example, articulated pistons require longer piston pins, making the total piston assembly (piston plus piston pin) generally heavier than one-piece aluminum piston assemblies. In addition, since the piston crown and skirt move independently of each other, the skirt cannot effectively function to guide movement of the piston crown. Accordingly, the piston land has to guide movement of the piston crown. This results in land-to-cylinder liner contact which can cause cavitation problems. Another design limitation associated with articulated pistons is that there is no connection between the ring belt and skirt. This allows stresses to be very high in the cooling gallery and on the bowl edge which can cause cracks to occur. Moreover, the lack of connection between the ring belt and skirt and resulting stresses allow for ring groove deformations to be very high which can cause oil consumption, blow-by, and emission problems.

Piston designers have been trying very hard to come up with new technologies to overcome the problems associated with articulated pistons. A number of proposed solutions have focused on one-piece steel pistons. Unlike articulated pistons, the skirt and crown of one-piece steel pistons form an integrated unit with the piston crown having a cooling gallery. Examples of patented one-piece steel pistons are found in DE 44 46 726 A1 to Kemnitz, U.S. Pat. No. 6,223,701 to Kruse, EP 0 992 670 A1 to Gaiser et al., and International Application Publication No. WO 01/50042 to Gaiser et al.

One of the most challenging aspects of one-piece piston designs is creating a cooling gallery in the piston crown while at the same time ensuring sufficient margins for fatigue strength and minimizing ring groove deformations subject to loads. In DE 44 46 726 A1 the piston is not connected between ring belt and skirt. Therefore, the overall structure of the piston is not stable and high stress can cause deformation to occur in the piston crown. In addition, because the skirt of the piston is short in DE 44 46 726 A1, high contact pressures will be created between the skirt and cylinder liner. Moreover, the shortness of the skirt used in DE 44 46 726 A1 limits the ability of the skirt to guide the movement of the piston so that cavitation can occur with respect to the cylinder liner. Overall, the process of manufacturing the one-piece piston of DE 44 46 726 A1 is very intensive.

In WO01/50042 A1 upper and lower crown sections are joined by a friction weld. The friction welding used in this piston design changes the original material properties. Moreover, cracks can occur in the welding area either during welding or during subsequent heat treatment or operational heating. In addition, because welding flashes in a cooling gallery cannot be removed they will reduce the effective cooling gallery volume and could, in a worst case scenario, block the cooling gallery completely. Further, as a result of friction welding, metal particles remaining in the cooling gallery could damage an engine if they are released from the cooling gallery while the engine is running.

The present invention is directed to one-piece steel pistons that are made from piston blanks that are provided with at least one portion that is configured and designed to be displaced to form a cooling gallery and ring belt.

DISCLOSURE OF THE INVENTION

According to various features, characteristics and embodiments of the present invention which will become apparent as the description thereof proceeds, the present invention provides a one-piece piston that includes:

- a top;
- a pair of opposed pin bosses with pin bores formed therein;
- a skirt; and
- a cooling gallery that comprises an annular cavity formed in a side of the piston which annular cavity is closed by at least one flange structure which has been displaced so as to close the annular cavity and define a portion of the cooling gallery.

The present invention further provides a piston blank from which a piston can be fabricated, the piston blank including a top portion, a skirt, a pair of opposed pin bosses and at least one radially extending flange, the at least one radially extending flange being configured to be displaced to contact another portion of the piston.

The present invention also provides a method of fabricating a one-piece piston which involves:

providing a piston blank having a top portion, a skirt, a pair of opposed pin bosses and at least one radially extending flange;

forming an annular cooling gallery in the piston blank; and displacing the at least one radially extending flange so as to close off the cooling gallery.

BRIEF DESCRIPTION OF DRAWINGS

The present invention will be described with reference to the attached drawings which are given as non-limiting examples only, in which.

BEST MODE FOR CARRYING OUT THE INVENTION

Figure 1:
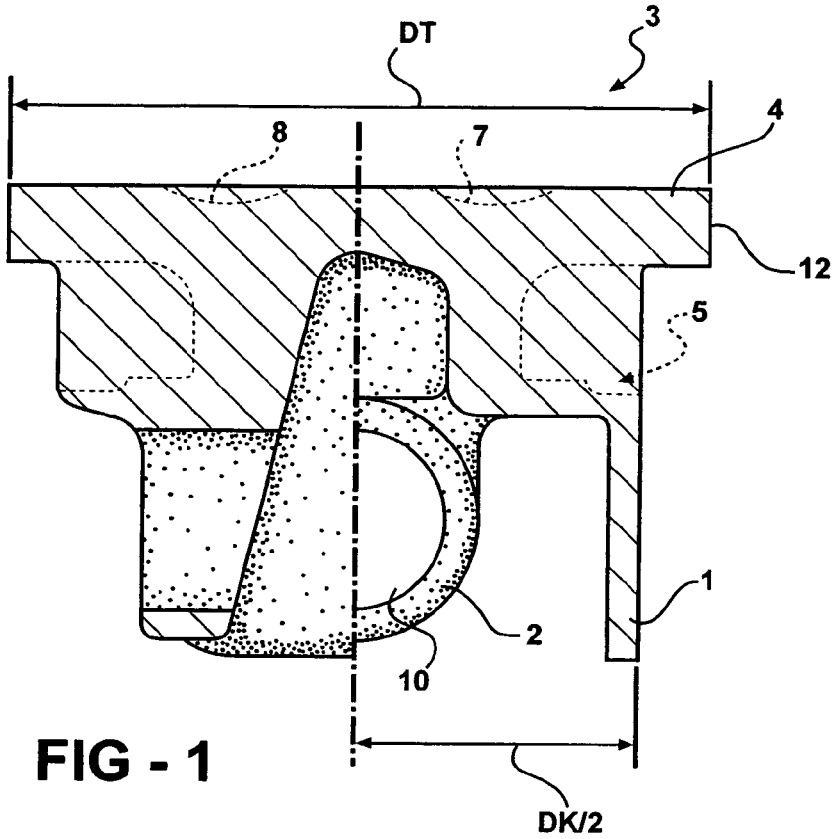
FIG. 1 is a compound cross-sectional view through the pin bore (right hand side) and along the thrust axis (left hand side) of a piston according to one embodiment of the present invention shown in half section before a flange formed on the piston is worked into its final position.

The present invention is directed to one-piece steel pistons for internal combustion engines. The one-piece steel pistons of the present invention are formed from single unitary steel forged or cast parts which are subsequently subjected to machining and metal working processes. The one-piece steel pistons include cooling galleries which may be partially formed during the forging or casting process and which are otherwise completely formed after the subsequent machining and metal working. The pre-machined, pre-metal-worked forged or cast parts are referred to herein as "piston blanks." According to the present invention the piston blanks each include at least one portion that is configured to be displaced during metal working so as to define the final structure of the one-piece pistons. The forged or cast parts from which the one-piece steel pistons are produced can also be provided with and/or machined to have abutment portions which assist in properly positioning the displaced portions as they are displaced. The displaced portions can be welded to, or configured to mechanically interlock with, an adjacent portion of the piston.

The process of manufacturing the one-piece steel pistons of the present invention involves forging or casting a pre-machined and pre-metal worked piston or piston blank that includes a top portion, a skirt, a pair of opposed pin bosses, and one or more flanges that extend radially outward from the top and/or a side portion of the piston blank. Optionally, the pre-machined and pre-metal-worked piston blank can be forged or cast with a rough (pre-finished) crown bowl and/or a rough (pre-finished) cooling gallery and/or rough (pre-finished) pin bores. In the next step the cooling gallery is provided or finished by a machining step and an annular abutment (when used) is formed at an appropriate location to assist in properly positioning the displaced portions as they are displaced. Next, the flange(s) is/are bent or folded downward and/or upward so that the peripheral edge of the flange (s) abutments an adjacent portion of the piston. Prior to bending or folding the flange(s), the flange(s) is/are machined so that the peripheral edge of the flange(s) is/are dimensioned and configured to cooperate with an adjacent portion of the piston to either mechanically engage or to be welded to the adjacent portion of the piston. After the flange(s) is/are bent or folded into position, grooves for compression rings and an oil ring are formed in a portion of the flange(s) that defines the ring belt in the finished piston. At any convenient time during the above steps, the pin bores may be provided and/or finished and the under crown area can be machined out as desired to reduce overall weight.

The one-piece steel pistons of the present invention can be made from any suitable steel material that can be worked as described herein and that is capable of withstanding the high combustion pressures, high piston speeds, high temperatures and mechanical stresses that are common in the environment of internal combustion engines. Various known types of carbon steel materials are suitable for purposes of the present invention. The piston blank can be made by a forging or casting process.

Reference will hereafter be made to the attached drawings in which common reference numbers are used throughout the various figures to identify similar elements when possible.

FIG. 1 is a compound cross-sectional view through the pin bore (right hand side) and along the thrust axis (left hand side) of a piston according to one embodiment of the present invention shown in half section before the T-form flange is worked into its final position. The piston depicted in FIG. 1 is a steel piston blank that includes a piston skirt 1 opposed pin bosses 2 and a piston head 3. A flange 4 extends radially outward from the central portion of the piston head 3 near the top. As indicted in FIG. 1, the diameter, DT, of flange 4 is greater than the diameter, DK, of the skirt 1. The diameter, DT, of the flange 4 is greater than the diameter, DK, of the skirt 1 by an amount that is equal to or greater than the difference in height between the top of the piston and the top 5 of the skirt 1. The flange 4 is referred to herein as a T-fold flange due to its cross-sectional shape in relationship to the piston head 3 and the manner in which the flange 4 is folded or bent by machining as discussed in detail below to form the final one-piece steel piston.

As indicated in broken lines, the piston head 3 can be forged or cast with a crown shape 7 or otherwise formed to have a flat top 8. In addition, as indicated in broken lines, a cooling gallery 9 can be partially or completely formed in the forged or cast piston blank. It is also possible to form rough pin holes 10 during the forging or casting of the piston as indicated in broken lines in FIG. 1. Although the design of the one-piece steel piston of the present invention is novel, the steel forged or cast piston blank depicted in FIG. 1 can be made using conventional forging or casting techniques that are well known to those skilled in the art.

An alternative to forming a crown shape 7 in the forged or cast piston blank and/or forming a cooling gallery 9 in the forged or cast piston blank and/or forming a pin bore 10 in the forged or cast piston blank would be to machine one or more of these features in the forged or cast piston blank. However, forming these features in the forged or cast piston blank would reduce machining and material costs.

Figure 2:
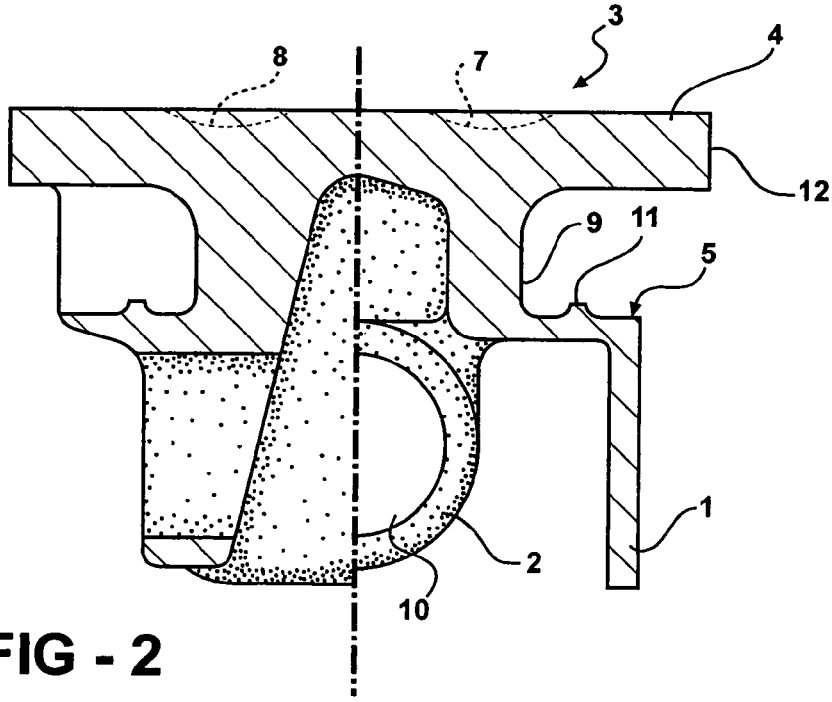
FIG. 2 is a compound cross-sectional view of a piston according to FIG. 1 shown in half section with a cooling gallery machined into the piston and a stop-log formed on the top of the piston skirt.

FIG. 2 is a compound cross-sectional view of a piston according to FIG. 1 shown in half section with the cooling gallery machined to include a stop-log on the top of the piston skirt. In the embodiment of the piston depicted in FIG. 2 the cooling gallery 9 has been machined to a finished state in the piston. In addition, an abutment 11 has been formed on the top 5 of the skirt 1. The abutment 11 also referred to as a stop-log has an annular shape that extends circumferentially within the cooling gallery 9 along the top 5 of the skirt 1.

Figure 3:
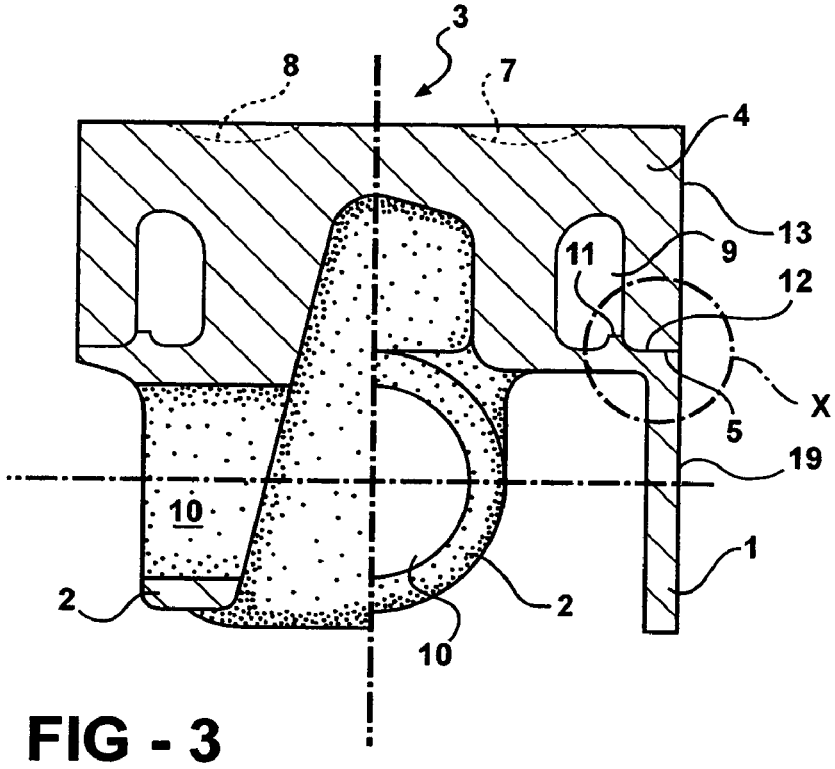
FIG. 3 is a compound cross-sectional view of a piston according to FIG. 1 shown in half section with the flange positioned into its final position.

FIG. 3 is a compound cross-sectional view of a piston according to FIG. 1 shown in half section with the T-form flange positioned into its final position. In FIG. 3 the flange 4 has been bent or folded from its position depicted in FIGS. 1 and 2 to a position in which the flange 4 closes cooling gallery 9. As shown in FIG. 3, the outer peripheral edge 12 of the flange 4 shown in FIGS. 1 and 2 has been displaced by bending or folding the flange 4 so that the peripheral edge 12 contacts abutment 11 and rests on top 5 of the skirt 1.

From FIG. 3 it can be seen that the flange 4 is configured, e.g. forged or cast and/or machined, so that when the peripheral edge 12 of the flange 4 contacts abutment 11, the annular side surface 13 of the flange 4 (formerly top surface) is substantially in alignment with the annular side surface 14 of the skirt 1 so that the overall outer annular surface of the final piston is substantially continuous. The peripheral edge 12 of the flange 4 has also been machined in FIG. 3 so as to conform to the configuration of the abutment 11.

The flange 4 can be bent or folded from its forged position depicted in FIG. 1 to its position depicted in FIG. 3 by bending the flange 4 downwards towards the skirt 1 while spinning the piston about its central axis. During the bending process the flange 4 can be heated. In addition, the bending of the flange 4 can be performed in one or more steps. It is also possible to bend the flange 4 toward the skirt 1 using one or more bending forms or any other conventional metal forming processes/apparatus.

Figure 4:
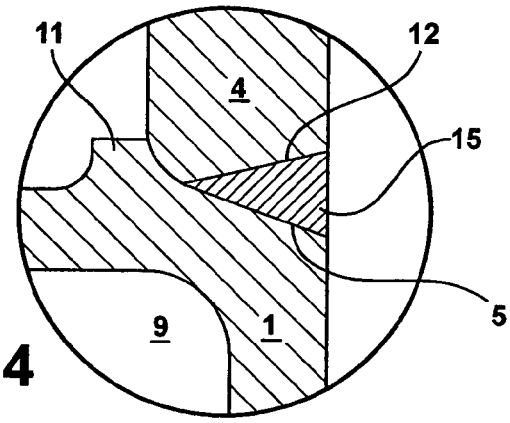
FIG. 4 is a sectional view depicting one manner in which the flange is welded to the top of the piston skirt according to one embodiment of the present invention.

FIG. 4 is a sectional view depicting one manner in which the flange is welded to the top of the piston skirt according to one embodiment of the present invention. In FIG. 4 the peripheral edge 12 of the flange 4 is welded to the top 5 of the skirt 1 using a conventional welding technique. FIG. 4 depicts the weld seam 15 as being substantially flush with the outer annular surfaces of the flange 4 and the skirt 1. Such a configuration can be achieved by providing any necessary gap between the peripheral edge 12 of the flange 4 and the top 5 of the skirt 1 and, after welding, finishing the weld bead so that the seam 15 is smooth. It is noted that the weld seam 15 can be configured so that it does not extend into the cooling gallery 9. Accordingly, there is no apprehension that flashing from the welding process will obstruct the cooling gallery 9 or that the welding process will deposit metal particles in the cooling gallery 9 which could be released during operating of an engine containing the piston.

Figure 5:
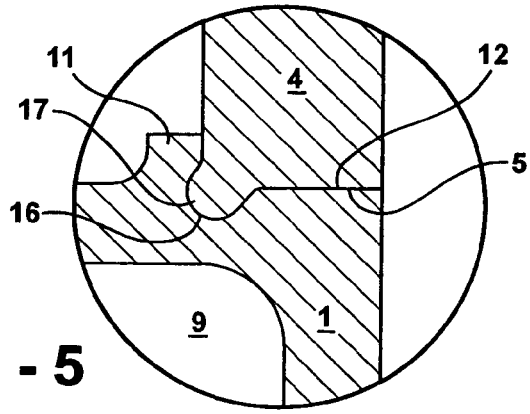
FIG. 5 is a sectional view depicting one manner in which the flange can be mechanically coupled to the top of the piston skirt according to one embodiment of the present invention.

FIG. 5 is a sectional view depicting one manner in which the flange can be mechanically coupled to the top of the piston skirt according to one embodiment of the present invention. In the embodiment of the invention depicted in FIG. 5, the top 5 of the skirt 1 is provided with an annular recess 16 and the peripheral edge 12 of the flange 4 is provided with an annular projection 17 that is configured to be received in the recess 16. The recess 16 and projection 17 on the flange 4 are depicted as having circular cross-sectional shapes wherein the narrowest portion of the opening of the recess 16 is less than the diameter of the recess 16 so that the projection 17 can be press-fit into the recess and secured therein. In alternative embodiments of the present invention the mechanical coupling of the flange 4 to the top 5 of the skirt 1 can be achieved using any cooperating, engaging structures which prevent the flange 4 from separating from the top 5 of the skirt 1, including one or more recesses/projections having various configurations.

Figure 6:
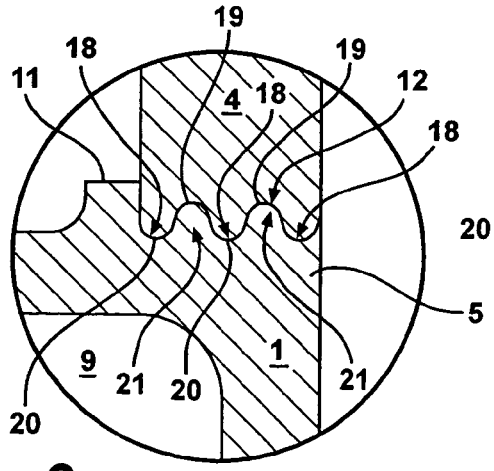
FIG. 6 is a sectional view depicting one manner in which the flange can be mechanically coupled to the top of the piston skirt according to another embodiment of the present invention.

FIG. 6 is a sectional view depicting one manner in which the flange can be mechanically coupled to the top of the piston skirt according to another embodiment of the present invention. In the embodiment of the invention depicted in FIG. 6 the peripheral edge 12 of the flange 4 is provided with alterative projections 18 and recesses 19 that engage and interlock with complementarily shaped recesses 20 and projections 21 formed on the top 5 of the skirt 1. From FIGS. 5 and 6 it can be understood that the mechanical coupling of the flange 4 to the top 5 of the skirt 1 can be achieved using any cooperating, engaging structures which prevent the flange 4 from separating from the top 5 of the skirt 1 and that the invention is not limited to the mechanical coupling structures depicted in FIGS. 5 and 6.

Figure 7:
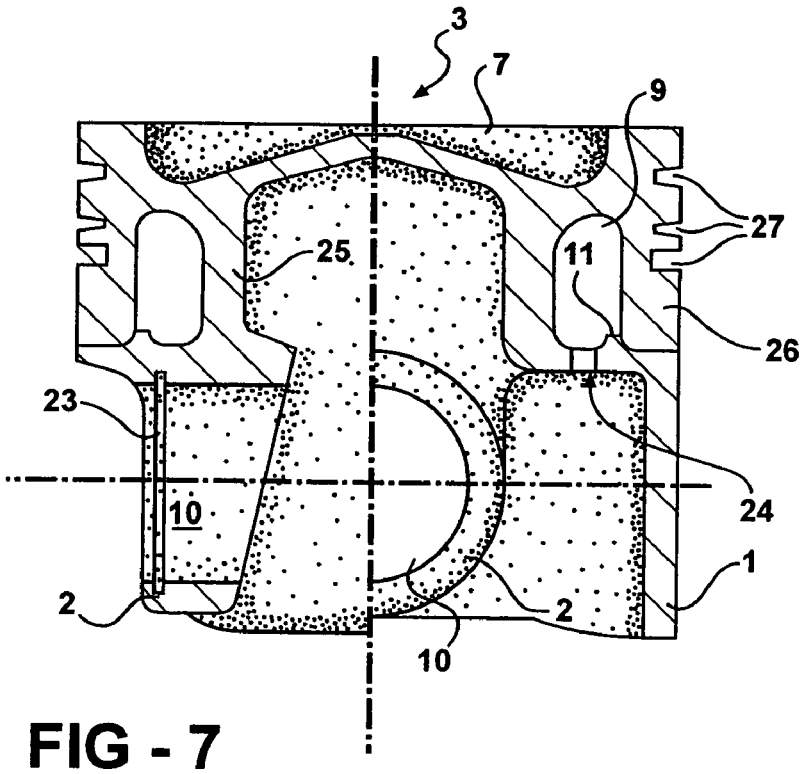
FIG. 7 is a compound cross-sectional view of a piston according to one embodiment of the present invention shown in half section with ring grooves formed in the flange.

FIG. 7 is a compound cross-sectional view of a piston according to one embodiment of the present invention shown in half section with ring grooves formed in the flange. FIG. 7 depicts a finished piston that includes a bowl shaped crown 7 and a pair of opposed pin bosses 2 with finished pin bores 10 therein (one shown) and snap ring grooves 23 (one shown). FIG. 7 also depicts an oil injection port 24 provided in the bottom of cooling gallery 9 into which oil can be injected for cooling the cooling gallery 9 according to known methods. In the piston shown in FIG. 7 the under crown area 25 has been machined away to reduce overall weight of the piston.

In one of the final manufacturing steps, the ring belt 26 (defined by the flange 4) of the piston will be provided with grooves 27 for receiving piston rings including one or more compression rings and an oil ring in a known manner.

As can be appreciated, the final piston (shown in FIG. 7) is a one-piece steel piston having an internal cooling gallery and a crown and skirt that are formed as an integrated unit. The one-piece steel piston of the present invention is made without the use of friction welding and therefore avoids problems and concerns associated with friction welding.

The process of manufacturing the one-piece steel pistons of the present invention involves forging or casting a pre-machined and pre-metal worked piston or piston blank as shown in FIG. 1 that includes a top, a skirt 1, a pair of opposed pin bosses 2 and a flange 4 that extends radially outward from the top. Optionally, the pre-machined and pre-metal worked forged or cast piston or piston blank can be forged or cast with a rough (pre-machined) crown bowl 7 and/or a rough (pre-machined) cooling gallery 9.

In the next step the cooling gallery 9 is provided or otherwise finished by a machining step and an annular abutment 11 is formed at the top 5 of the skirt 1 as shown in FIG. 2.

Next, the flange 4 is bent or folded downward so that the peripheral edge 12 of the flange 4 contacts abutment 11 and rests on the top 5 of the skirt 1 as shown in FIG. 3. Prior to bending or folding the flange 4 the flange 4 is machined so that the peripheral edge 12 cooperates with the abutment 11 and is either welded to the top 5 of the skirt 1 or mechanically engages the top 5 portion of the skirt 1. In addition, the flange 5 is machined so as to have an outer annular surface after bending or folding that is substantially flush with the annular outer surface of the skirt 1 which has also been machined to a finished state. The machining of the annular surfaces of the skirt 1 and flange 4 can be conducted after the flange 4 is bent or folded.

After the flange 4 is bent or folded grooves 27 for compression rings and an oil ring are formed in a portion of the flange 4 that defines the ring belt 26.

At any convenient time during the above steps, the pin bore can be provided and/or finished and the under crown area can be machined out as desired to reduce overall weight.

FIGS. 1-3 and 7 are directed to embodiments of the present invention in which a flange 4 is provided near the top of the piston blank and subsequently bent or folded downward to close cooling gallery 9.

In further embodiments of the present invention the piston blank can be provided with a flange that is bent or folded upward to close a cooling gallery or flanges that are bent or folded downwards and upwards together to close a cooling gallery. In addition to closing the cooling galleries, the flanges could be configured to, after being bent or folded and machined, define portions of the sides or tops of the pistons.

Figure 8:
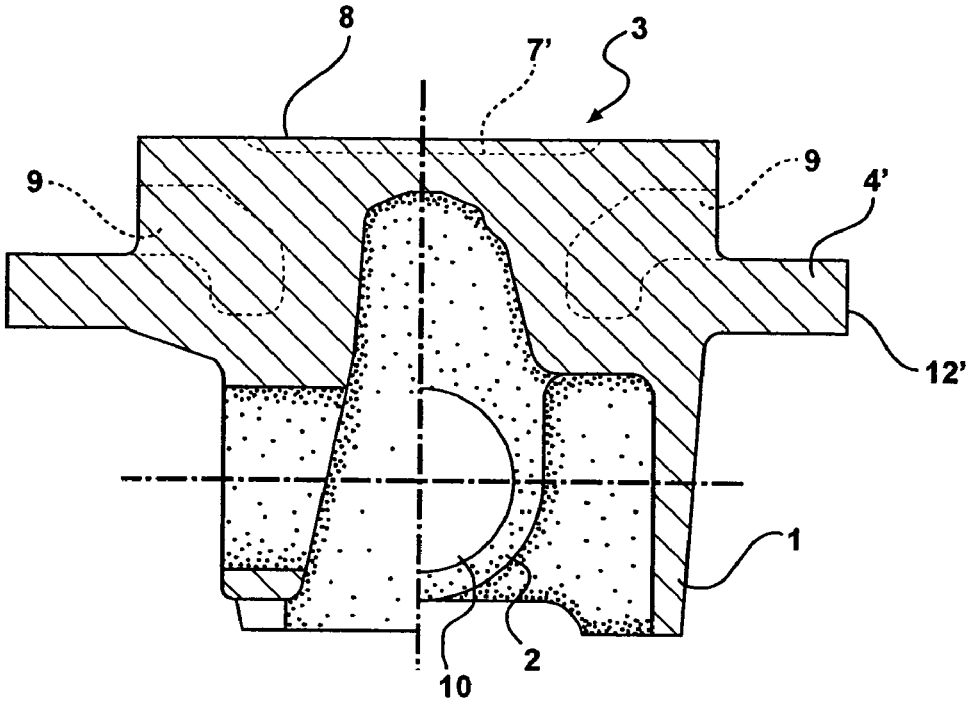
FIG. 8 is a compound cross-sectional view through the pin bore (right hand side) and along the thrust axis (left hand side) of a piston according to another embodiment of the present invention shown in half section before a flange formed on the piston is worked into its final position.

FIG. 8 is a compound cross-sectional view through the pin bore (right hand side) and along the thrust axis (left hand side) of a piston according to another embodiment of the present invention shown in half section before a flange formed on the piston is worked into its final position.

The piston depicted in FIG. 8 is a steel piston blank that includes a piston skirt 1 opposed pin bosses 2 and a piston head 3. A flange 4' extends radially outward from the central portion of the piston head 3 from a location that is midway between the top of the piston and the top of the piston skirt 1. The diameter of flange 4' is greater than the diameter of the skirt 1 by an amount that is sufficient to, after any necessary machining, close the cooling gallery as shown in FIG. 10. In the embodiment of the invention depicted in FIGS. 8-10, the flange 4' is configured to be bent or folded under an edge 28 of the top of the piston which is depicted in FIG. 9.

As indicated in broken lines, the piston head 3 can be forged or cast with a recessed shape 7' or otherwise formed to have a flat top 8. In addition, as indicated in broken lines, a cooling gallery 9 can be partially or completely formed in the forged or cast piston. It is also possible to form rough pin holes 10 during the forging or casting of the piston as indicated in broken lines in FIG. 8. The steel forged or cast piston blank depicted in FIG. 8 can be made using conventional forging or casting techniques that are well known to those skilled in the art.

An alternative to forming a crown shape 7' in the forged or cast piston blank and/or forming a cooling gallery 9 in the forged or cast piston blank and/or forming a pin bore 10 in the forged or cast piston blank would be to machine one or more of these features in the forged or cast piston blank. However, forming these features in the forged or cast piston blank would reduce machining and material costs.

Figure 9:
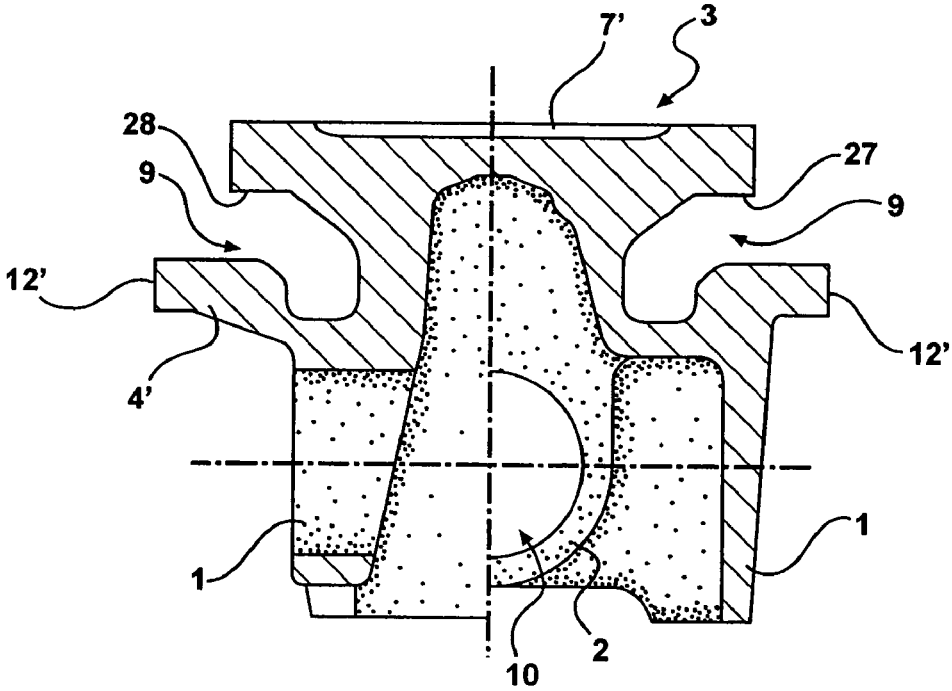
FIG. 9 is a compound cross-sectional view of a piston according to FIG. 8 shown in half section with a cooling gallery machined into the piston.
Figure 10:
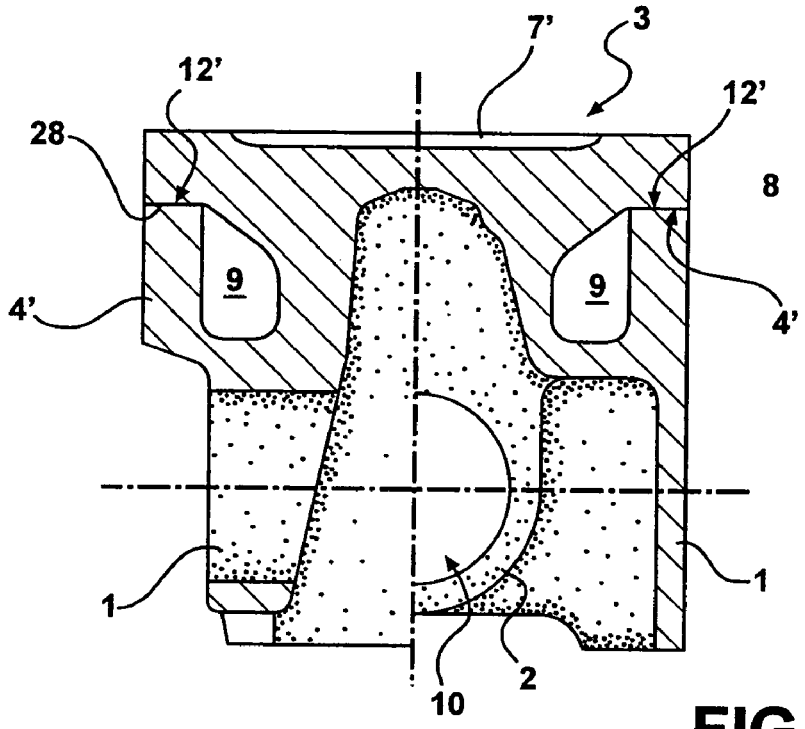
FIG. 10 is a compound cross-sectional view of a piston according to FIG. 9 shown in half section with the flange positioned into its final position.

FIG. 9 is a compound cross-sectional view of a piston according to FIG. 8 shown in half section with a cooling gallery machined into the piston. In the embodiment of the piston depicted in FIG. 9, the cooling gallery 9 has been machined to a finished state in the piston. In addition, an abutment similar to that shown in FIG. 2 can be formed on under edge 28 near the top of the piston if desired. If an abutment is used in this embodiment of the present invention it should have an annular shape that extends circumferentially within the cooling gallery 9 beneath the edge 28 as depicted. It is to be understood that while the abutment structures discussed herein are useful in assisting in the proper positioning and alignment of the flanges when they are displaced, it is possible to eliminate the abutments as long as more care is taken to bend of fold the flanges into their correct portions.

FIG. 10 is a compound cross-sectional view of a piston according to FIG. 9 shown in half section with the flange positioned into its final position. In FIG. 10 the flange 4 has been bent or folded from its position depicted in FIGS. 8 and 9 to a position in which the flange 4' closes cooling gallery 9. As shown in FIG. 10, the outer peripheral edge 12' of the flange 4' shown in FIGS. 8 and 9 has been displaced by bending or folding the flange 4' so that the peripheral edge 12' is beneath edge 28.

From FIG. 10 it can be seen that the flange 4' is configured, e.g. forged or cast and/or machined, so that when the peripheral edge 12' of the flange 4' contacts abutment 11, the annular side surface 13' of the flange 4 (formerly bottom surface) is substantially in alignment with the annular side surface 14 of the skirt 1 so that the overall outer annular surface of the final piston is substantially continuous. The peripheral edge 12' of the flange 4' has also been machined in FIG. 10 so as to conform to the configuration of the abutment 11.

The flange 4' can be bent or folded from its forged position depicted in FIG. 8 to its position depicted in FIG. 10 by bending the flange 4' upwards while spinning the piston about its central axis. During the bending process the flange 4' can be heated. In addition, the bending of the flange 4' can be performed in one or more steps. It is also possible to bend the flange 4' upward using one or more bending forms or any other conventional metal forming process/apparatus.

The peripheral edge 12' of the flange 4' can be welded to the lower surface of edge 28 according to one embodiment of the present invention using conventional welding techniques. In such a case the resulting weld seam should be substantially flush with the outer annular surfaces of the flange 4' and the edge 28. Such a configuration can be achieved by providing any necessary gap between the peripheral edge 12' of the flange 4' and the lower surface of edge and, after welding, finishing the weld bead so that the seam is smooth. It is noted that the weld seam can be configured so that it does not extend into the cooling gallery 9. Accordingly, there is no apprehension that flashing from the welding process will obstruct the cooling gallery 9 or that the welding process will deposit metal particles in the cooling gallery 9 which could be released during operating of an engine containing the piston.

As an alternative to welding peripheral edge 12' of the flange 4' flange to the lower surface of edge 28 the opposing structures can be configured to mechanically interlock using structural configurations similar to those exemplified and discussed in reference to FIGS. 5 and 6 above. It is understood that the invention is not limited to the mechanical coupling structures depicted in FIGS. 5 and 6.

The concept of providing a piston blank with a displaceable flange is not limited to the embodiments of the invention depicted in FIGS. 1-3, 7 and 8-10. In other embodiments the flanges could be positioned and configured to be bent or folded upward or downward and close off different areas of the cooling galleries. In other embodiments more than one flange can be used.

FIGS. 11-14 exemplify other embodiments of the present invention which include different flange configurations. Each of FIGS. 11-14 depicts pistons in which the respective flanges have been machined and bent or folded into their final positions. However, it is readily understood that before being machined and bent or folded the flanges extended radially outward from the sides of piston blanks that included features which are generally discussed above.

Figure 11:
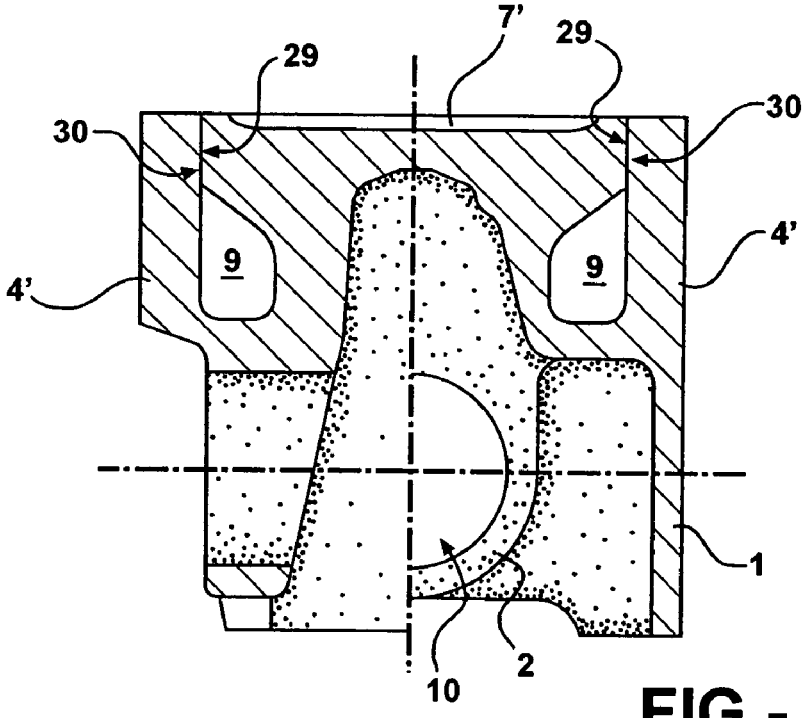
FIG. 11 is a compound cross-sectional view of a piston according to an alternative embodiment of the present invention.

FIG. 11 is a compound cross-sectional view of a piston according to an alternative embodiment of the present invention. In FIG. 11, the flange 4' was originally configured in the piston blank so that when it was bent or folded upward (after being machined to size), a top peripheral edge 29 of the flange 4' abutted a peripheral edge 30 provided or formed adjacent to the top of the piston.

Figure 12:
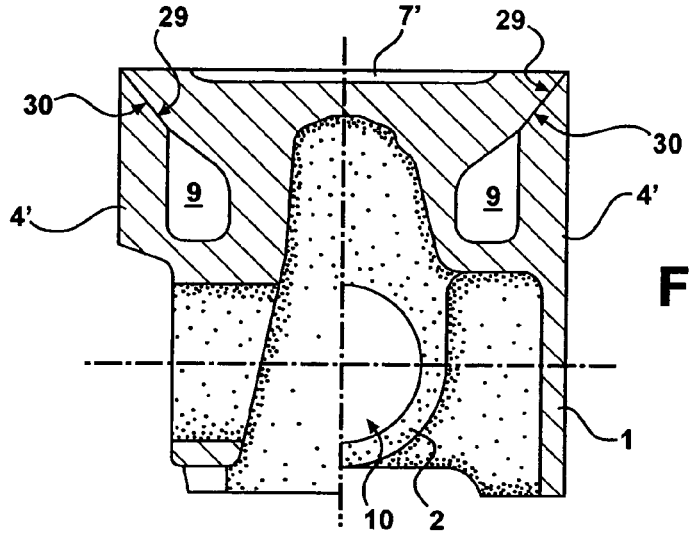
FIG. 12 is a compound cross-sectional view of a piston according to another alternative embodiment of the present invention.

FIG. 12 is a compound cross-sectional view of a piston according to another alternative embodiment of the present invention. In FIG. 12, the flange 4' was originally configured in the piston blank so that when it was bent or folded upward (after being machined to size) the abutting surfaces between the peripheral edge 29 of the flange 4' and the peripheral edge 30 of the top of the piston met along an angle as shown.

Figure 13:
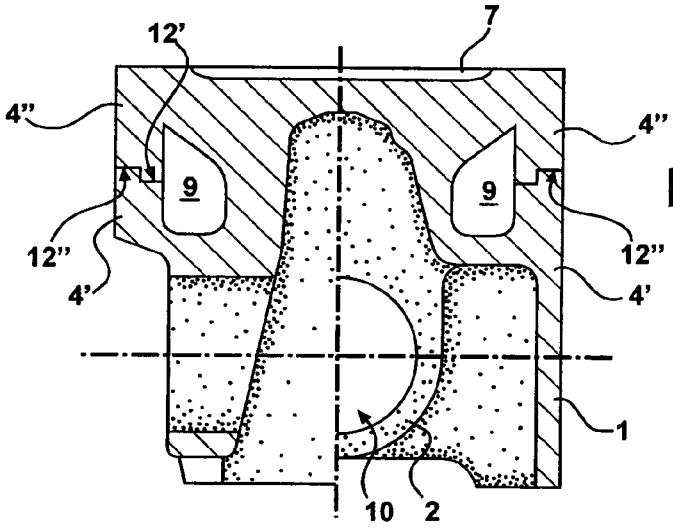
FIG. 13 is a compound cross-sectional view of a piston according to another alternative embodiment of the present invention.

FIG. 13 is a compound cross-sectional view of a piston according to another alternative embodiment of the present invention. In FIG. 13, two flanges 4' and 4" were originally provided and configured in the piston blank so that when the upper flange was bent or folded downward and the lower flange was bent or folded upward (after being machined to size) the respective peripheral edges 12' and 12" of the flanges 4' and 4" abutted one another as depicted.

Figure 14:
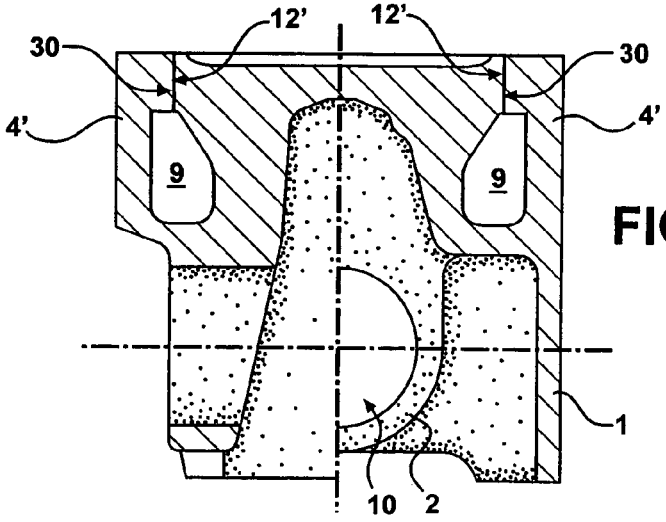
FIG. 14 is a compound cross-sectional view of a piston according to another alternative embodiment of the present invention.

FIG. 14 is a compound cross-sectional view of a piston according to another alternative embodiment of the present invention. In FIG. 14, the flange 4' was originally configured in the piston blank so that when it was bent or folded upward (after being machined to size) the abutting surfaces between the peripheral edge 12' of the flange 4' and the peripheral edge 30 of the top of the piston met over a portion of the cooling gallery 9 as shown.

It is noted that the shape of the cooling gallery can be changed to accommodate the use of different flange configurations.

In each of the embodiments depicted in FIGS. 11-14 and in other further embodiments of the present invention that are based upon the general concepts exemplified, the opposing structures can welded together or otherwise be configured to mechanically interlock using structural configurations similar to those exemplified and discussed in reference to FIGS. 5 and 6 above or similar configurations.

Although the present invention has been described with reference to particular means, materials and embodiments, from the foregoing description one skilled in the art can easily ascertain the essential characteristics of the present invention and various changes and modifications can be made to adapt the various uses and characteristics without departing from the spirit and scope of the present invention as described above and set forth in the attached claims.

What is claimed is:

1. A method of fabricating a one-piece piston, said method comprising the steps of:

providing a piston blank having a top portion, a skirt, a crown having circumferential face that extends from the skirt to the top of the piston, a pair of opposed pin bosses and at least first and second flanges;

forming an annular cooling gallery in the piston blank;

and displacing the at least first flange upward and displacing said at least second flange downward so as to close off the cooling gallery.

2. The method of claim 1, wherein the annular cooling gallery is formed at least in part by a machining process.

3. The method of claim 1, wherein the piston blank is made by one of a forging or casting process.

4. The method of claim 1, wherein the at least first and second flanges are displaced by bending.

5. The method of claim 4, wherein said displaced first and second flanges define substantially an entire circumferential face of the crown of the piston.

6. The method of claim 1, further comprising the step of attaching a portion of the at least first and second flanges to each other.

7. The method of claim 6, wherein the step of attaching further comprises the step of welding a portion of the at least first and second flanges to each other.

8. The method of claim 6, wherein the step of attaching further comprises the step of mechanically engaging a portion of the at least first and second flanges to each other.

9. The method of claim 1, wherein each of the at least first and second flanges has a diameter that is greater than a diameter of the skirt.

10. A method of fabricating a one-piece piston, said method comprising the steps of:

providing a piston blank having a top portion, a skirt, a pair of opposed pin bosses and at least one radially extending flange;

forming an annular cooling gallery in the piston blank; and displacing the at least one radially extending flange upward so as to close off the cooling gallery, wherein the annular cooling gallery is partially formed in the piston blank by machine finishing the annular cooling gallery.

11. A method of fabricating a one-piece piston, said method comprising the steps of:

providing a piston blank for a piston having a top portion, a skirt, a crown with a circumferential face extending from the skirt to the top of the piston, a pair of opposed pin bosses and a first flange and a second flange;

forming an annular cooling gallery in the piston blank; and displacing the first flange upwardly and displacing the second flange downward so as to close off the cooling gallery, wherein the displaced first flange and displaced second flange form the circumferential face of the crown of the piston.

12. The method of claim 11, wherein the piston blank is initially formed using a forging or casting process.

13. The method of claim 11, wherein the first flange and second flange are each displaced by bending.

14. The method of claim 11, further comprising the step of attaching a portion of the first flange and to the second flange.

15. The method of claim 14, wherein the step of attaching further comprises the step of welding a portion of the first flange to the second flange.

16. The method of claim 14, wherein the step of attaching further comprises the step of mechanically engaging a portion of the first flange to the second flange.

17. The method of claim 11, wherein each of the first flange and second flange has a diameter that is greater than a diameter of the skirt.

* * * * *